US006178570B1

(12) United States Patent
Denst et al.

(10) Patent No.: US 6,178,570 B1
(45) Date of Patent: Jan. 30, 2001

(54) ADJUSTABLE MULTI-NOZZLE ROTATING HYDROTHERAPY JET SYSTEM

(75) Inventors: Sheldon Denst; Paul A. Dongo, both of Camarillo, CA (US)

(73) Assignee: B&S Plastics, Inc., Oxnard, CA (US)

( * ) Notice: Under 35 U.S.C. 154(b), the term of this patent shall be extended for 0 days.

(21) Appl. No.: 09/168,699

(22) Filed: Oct. 8, 1998

(51) Int. Cl.[7] ..... A61H 33/04

(52) U.S. Cl. ..... 4/541.6; 4/541.1; 4/541.3; 239/420; 239/587.4

(58) Field of Search ..... 4/541.6, 541.1, 4/541.2, 541.3, 541.4, 541.5, 546; 239/416.2, 417, 420, 587.4

(56) References Cited

U.S. PATENT DOCUMENTS

| | | | |
|---|---|---|---|
| 4,800,046 | 1/1989 | Malek et al. | 261/50.3 |
| 5,014,372 | 5/1991 | Thrasher et al. | 4/542 |
| 5,226,601 | 7/1993 | Hinojosa, Jr. et al. | 239/423 |
| 5,353,447 | 10/1994 | Gravatt | 4/541.6 |
| 5,462,230 * | 10/1995 | Van Ouwerkerk | 239/587.4 |
| 5,657,496 | 8/1997 | Corb et al. | 4/541.6 |
| 5,810,257 * | 9/1998 | Ton | 4/541.6 |
| 5,915,849 * | 6/1999 | Dongo | 4/541.1 |
| 5,920,925 * | 7/1999 | Dongo | 4/541.6 |

OTHER PUBLICATIONS

Waterway 1997 Product Catalog, 1997, 2 pages.

* cited by examiner

*Primary Examiner*—David J. Walczak
(74) *Attorney, Agent, or Firm*—Koppel & Jacobs

(57) ABSTRACT

The system includes a jet, a rotating member or "eyeball" housing a series of discharge nozzles that can be adjusted to vary the location of an outlet flow stream as well as the direction and speed of the eyeball's rotation. A high pressure water jet flows into the eyeball and exits through the discharge nozzles. Depending upon the adjustable orientation of the nozzles, relative to the rest of the eyeball, the eyeball can be rotated clockwise or counter-clockwise, and at varying speeds. The discharge nozzles are further positionable to permit them to be displaced in a common direction.

49 Claims, 9 Drawing Sheets

ADJUSTABLE MULTI-NOZZLE ROTATING HYDROTHERAPY JET SYSTEM

BACKGROUND OF THE INVENTION

1. Field of the Invention

The invention relates to rotary hydrotherapy jet.

2. Description of the Related Art

Various hydrotherapy jets have been developed in the past, for use in spas, hot tubs and bath tubs, that discharge an aerated stream of water in a rotating pattern. Such jets have been found to produce a pleasing massaging effect for many users, and have become quite popular.

One prior approach utilizes a rotary plug having one or more fixed-in-place, angled discharge conduits that receive a jet flow from a venturi nozzle. The angular displacement of the conduits results in rotation of the rotary plug. For example, see Waterway "1997 Product Catalog", page 2, Model Nos. 210-6750, 210-7750, 210-6070, 210-6170, 210-6370, and 210-6410. While these jets do provide an aerated stream of water in a rotating pattern, the direction of the flow is fixed and non-adjustable.

To overcome the drawbacks of the rotary plug design, jets were developed with an adjustable discharge tube. Example of this type of system are given in U.S. Pat. No. 5,353,447 and in Waterway "1997 Product Catalog", page 2, Model Nos. 210-6080, 210-6090, 210-6180, 210-6190, 210-6390, and 210-6400. While these jets have some degree of adjustability, they offer limited flexibility to adjust the output flow stream.

SUMMARY OF THE INVENTION

The present invention seeks to provide an adjustable multi-nozzle rotary hydrotherapy jet that is simple in design, can easily be fabricated using conventional molding techniques, has multiple degrees of adjustability, and provides easy operative control over the rotational speed, output flow angles and direction, plus a non-rotating option.

These goals are achieved with a new jet that includes a housing, a water inlet to the housing, a water nozzle within the housing that forms water flowing through the inlet into a jet, a series of adjustable outlet nozzles, and a support structure. The support structure holds the outlet nozzles downstream of the water nozzle to receive the jet flow and to discharge the flow through the nozzles. The support structure is rotatable along with the nozzles which it holds. When one or more of the nozzles are set at an off-axis angle, the water discharges causes the support structure and nozzles to rotate. The outlet nozzles are adjustable to vary their discharge angles, and thereby provide user control over the outlet flow angle, speed and direction of rotation. The angular adjustment preferably includes a setting at which the outlet nozzles axes are parallel to the rotation axis, and thus provide a non-rotational mode. In different implementations, the nozzles are adjustable independent of each other, or jointly.

Further features and advantages of the invention will be apparent to those skilled in the art from the following detailed description, taken together with the accompanying drawings.

DETAILED DESCRIPTION OF THE INVENTION

Figure 1:
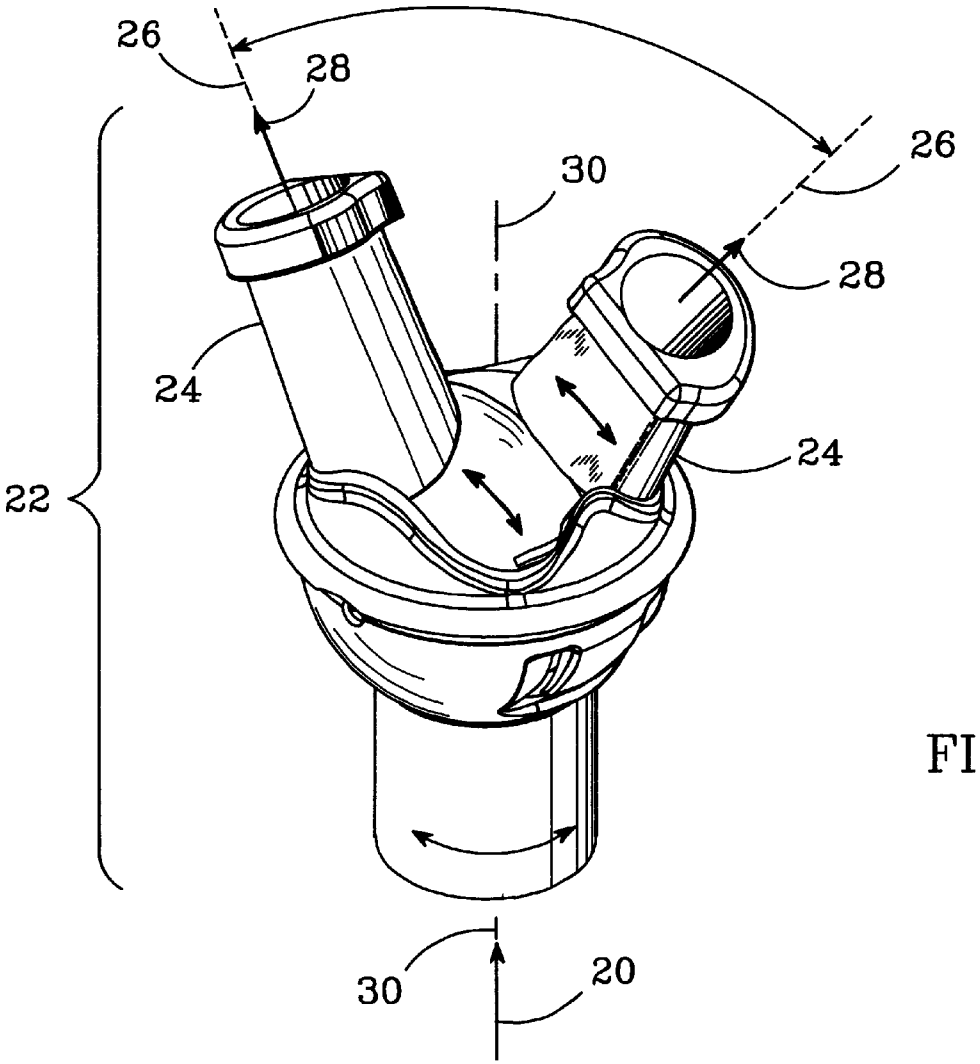
FIG. 1 is a elevation view of a rotary eye ball type jet having a series of adjustable water jet nozzles.

The invention relates to an adjustable multi-nozzle hydrotherapy jet which provides the user with the ability to adjust the discharge direction of a series of water nozzles on a multi-nozzle carrier to provide the user with a desired flow effect. The jet can be rotated in a clockwise or counter-clockwise direction, at varying rotational speeds and with different discharge patterns. As shown in FIG. 1, this is accomplished by passing a water jet 20 through a carrier that is preferrably a rotary eyeball fixture 22, causing it to rotate and discharge a jet flow 28 through a series of discharge nozzles 24 along respective discharge axes 26. Nozzles 24 are adjustable relative to a center rotation axis 30 to provide the user with a wide range of nozzle orientations and flow effects and to provide both clockwise and counter-clockwise rotation of eyeball 22. Furthermore, the systems design results in low pressure losses.

Figure 2:
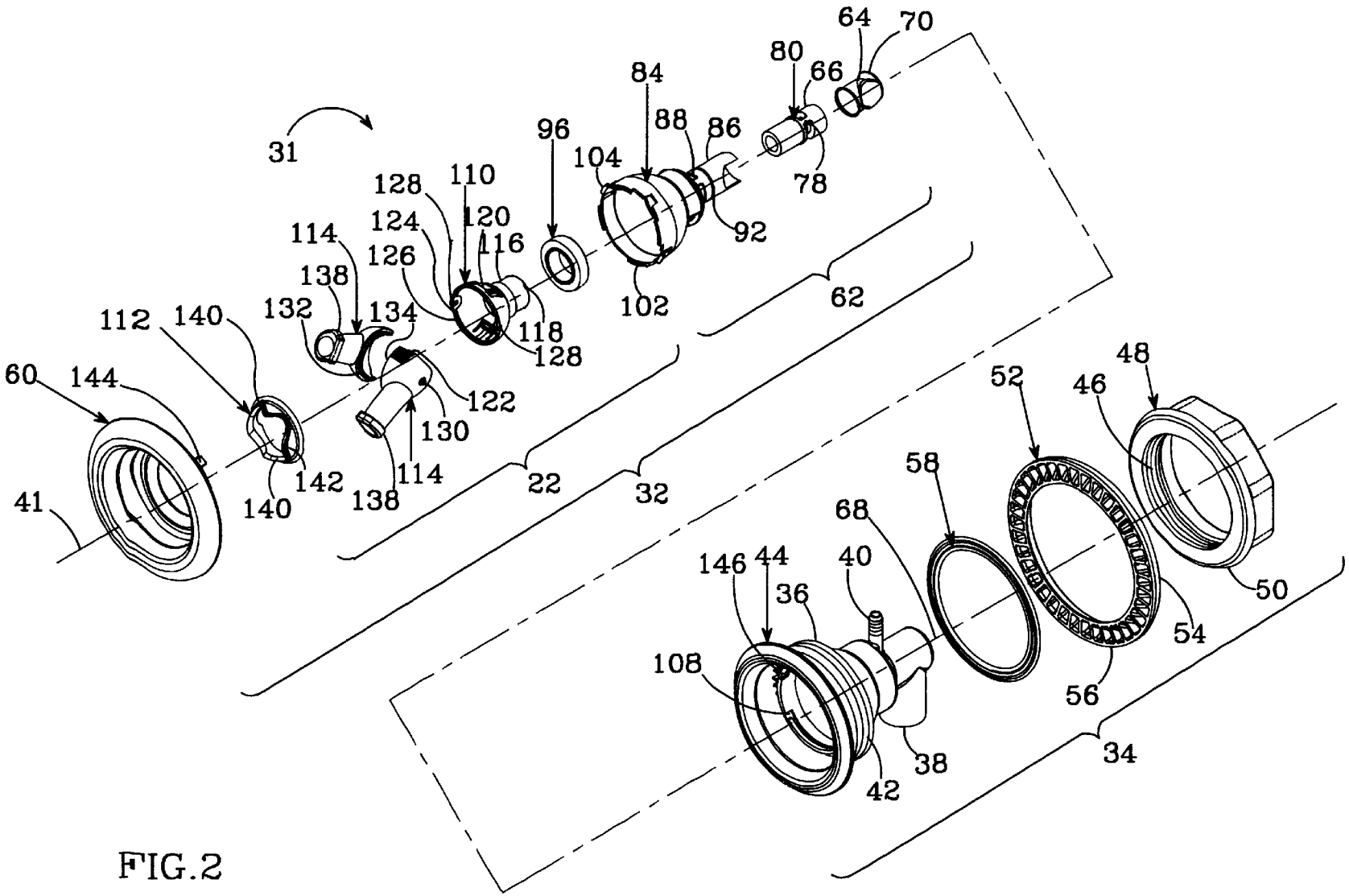
FIG. 2 is an exploded perspective view of the jet shown in FIG. 1.
Figure 3:
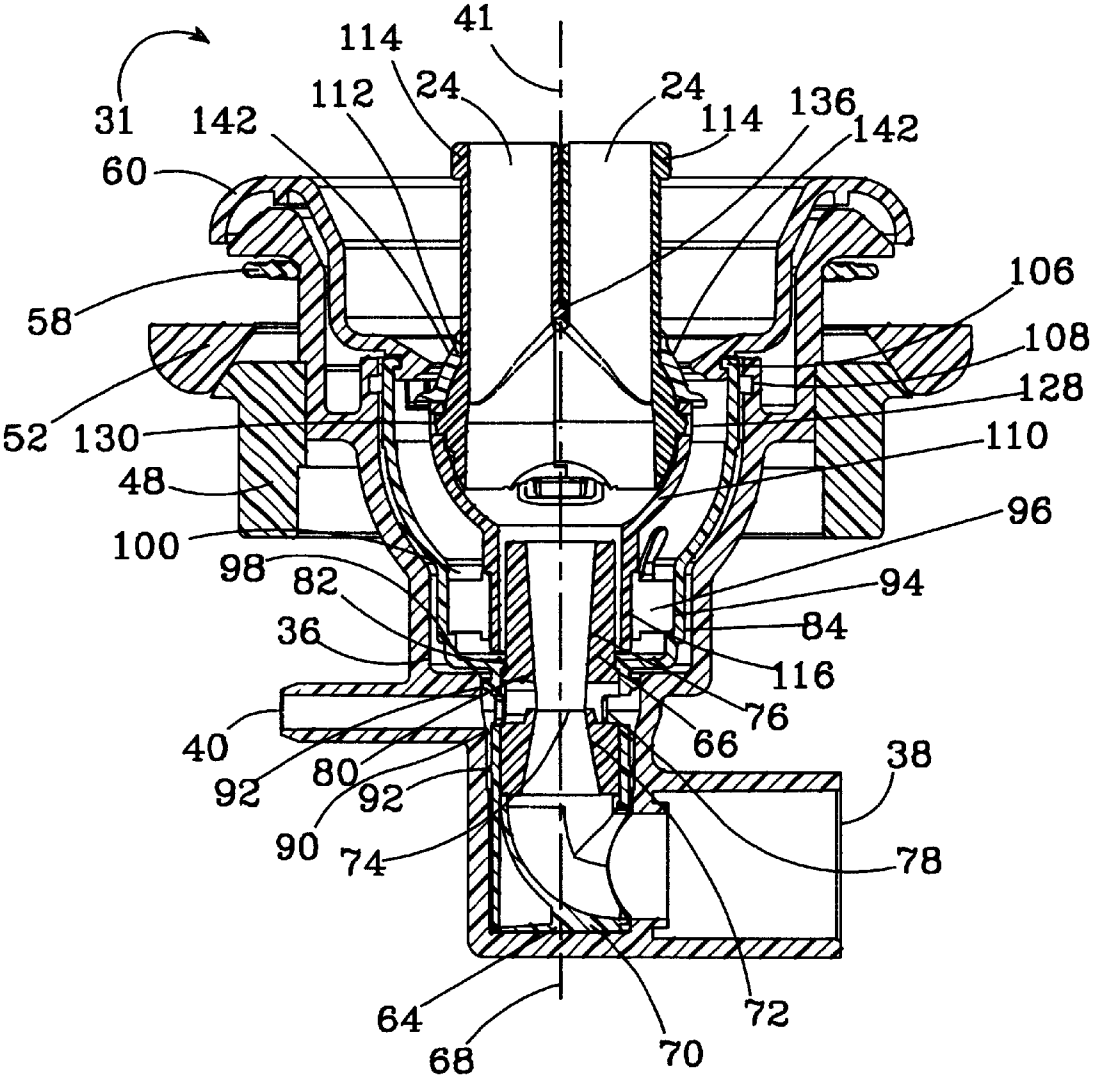
FIG. 3 is a section view of the jet shown in FIG. 1 in a depicting the outlet nozzles in a parallel configuration.

An adjustable multi-nozzle hydrotherapy jet 31 constructed in accordance with the invention is shown in FIGS. 2 and 3. Jet 31 includes jet internals 32 enclosed within a housing 34 that consists of a jet body 36 having a set of water and air inlet conduits 38 and 40. The conduits allow for the flow of water and air into the rear of the jet transverse to the jet's axis 41; in line rather then transverse water and/or air inlets could be provided if desired. The conduits include sockets at either end to receive tubing from adjacent jets or directly from water and air systems. Body 36 includes an exterior threading 42 around its perimeter and a flange 44 at its forward end. Threads 42 mate with internal threads 46 on a nut 48 that is used to hold the jet in place in a spa or tub. Molded into the forward side of nut 48 is a serrated tapered flange 50 that interfaces with a washer 52 when the nut is screwed onto jet body 36. At the back end of washer 52 is a taper 54 which matches the taper of flange 50. The forward side of washer 52 is a flat surface 56 for contacting a spa or tub wall. Tapers 50 and 54 compensate for irregularities that may exist in the tub or spa wall, but still allow for housing 34 to be held firmly in place. Housing 34 is held in place, protruding through an opening in the wall of the spa or tub, by sandwiching the spa or tub wall surrounding the opening between a gasket 58 on the inner surface of the wall and washer 52 on the outer wall surface. The rear portion of the jet body 36 extends through the gasket and washer to the outside of the tub or spa with the flange 44 located on the inside. The assembly is locked in place by tightly screwing the nut 48 onto the threaded exterior portion of jet body 36.

Jet internals 32 make up the active elements of jet 31 and include an escutcheon 60, a rotary eyeball 22 and a diverter 62. Housed within the aft end of diverter 62 is a water ramp 64 and a venturi housing 66. Water ramp 64 includes a curved cylindrical pathway in the shape of an elbow that mates with jet body 36 at its aft end, receives water from water conduit 38 and turns the flow stream parallel to the jets longitudinal axis 41. Adjacent to its aft end, water ramp 64 has a base plate 70 which is positioned within the rear of jet body 36 to provide alignment and to prevent movement. At its forward end water ramp 64 mates with and provide the flow stream directly into venturi housing 66.

Venturi housing 66 is a recoverable venturi type device that is primarily used to aerate the flow stream passing though the jet. At its aft end it mates with ramp 64, providing a smooth transition between the elements to minimize pressure loss. Venturi 66 has a forward section that tapers down to its smallest inner diameter at a throat 74. Aft of throat 74, venturi 66 expands in inner diameter to form an aft section 72. A series of slotted air openings 78 are located in the vicinity of throat 74 to receive air from air conduits 40 and to aerate water flowing through the jet. Water flowing through aft section 72 is gradually constricted, causing it to decrease in pressure and increase in flow rate, until reaching a maximum constriction at throat 74. After passing throat 74 the water enters the venturi's forward section 76 where the flow stream is expanded, increasing the fluid pressure and decreasing its flow rate. The differential in pressure created after throat 74 results in a low pressure area, in the vicinity of air openings 78, causing an inflow of air into the water flow stream. The design of venturi 66 can be conventional, and is based on the geometric constraints of the system and the desired pressure and flow rates of the flow stream. Forward of air openings 78, on its external surface, venturi 66 has a flange 80 that mates with a collar 82 located within a diverter body 84 to hold the venturi in place. Venturi 66 is available in a variety of sizes to provide varying degrees of aeration of the flow stream. The different venturi's jets are preferably interchangeable and provide a wide range of flow alternatives.

Diverter body 84, at its aft end, has a sleeve section 86 that houses ramp 64 and venturi 66. Internally within section 86, at its forward end, is collar 82 that mates with flange 80 holding venturi 66 in place and preventing forward movement. In this configuration, venturi 66 protrudes beyond collar 82 into diverter body 84. Aft of collar 82, are a series of aeration slots 88 that are aligned with an air passageway 90 formed in the inside surface of jet body 36. Slots 88 provide air to air opening 78 located within venturi 66. On the outside surface of body 84, both forward and aft of aeration slots 88, are located a series of ridges 92 that create a water seal between diverter body 84 and jet body 36 to prevent water from going into passageway 90. Forward of slots 88, internal to body 84, is located a bearing mount 94 that houses a rotary bearing 96. At the aft end of bearing mount 94 is located a bearing collar 98 which mates with the aft end of bearing 96. Located at the forward end of bearing mount 94 are located a series of bearing clips 100 that clip over the forward end of bearing 96 forcing it against collar 98 and retaining the bearing in place. Located at the forward end of body 84 are two sets of tabs 102 and 104, one set facing inward and one set facing outward. Tabs 102, facing inward, are spaced around the perimeter of body 84 and mate with a series of slots 106 located on escutcheon 60. Tabs 104, facing outward, mate with a slot 108 located on the inside surface of jet body 36 locking jet 32 in place.

Forward of diverter 62 is located rotary eyeball 22 which consists of a bottom cage 110 that mates with a top cage 112 housing a series of eyeball halves 114. Bottom cage 110, at its aft end, has a cylindrical sleeve 116 that mates with an inner race of bearing 96. Located on the aft end of sleeve 116 are a series of bearing locking tabs 118 which are used to hold bearing 96 in place. Forward of sleeve 116, cage 110 expands forming a hemispherical shaped area having a set of friction tabs 120 on its inner surface that interface with a series of ridges 122 located on eyeball halves 114. Tabs 120 interact with the ridges to help hold eyeball halves 114 in place during operation to prevent inadvertent movement. Along the forward edge of bottom cage 110 is a locking slot 124 and a series of locking tabs 126 that mate with a corresponding set of slot and tabs located on the aft end of top cage 112. Also along the forward end of cage 110 is a series of mounting holes 128 that mate with a set of mounting pins 130 located on eyeball halves 114 holding them in place.

Figure 4:
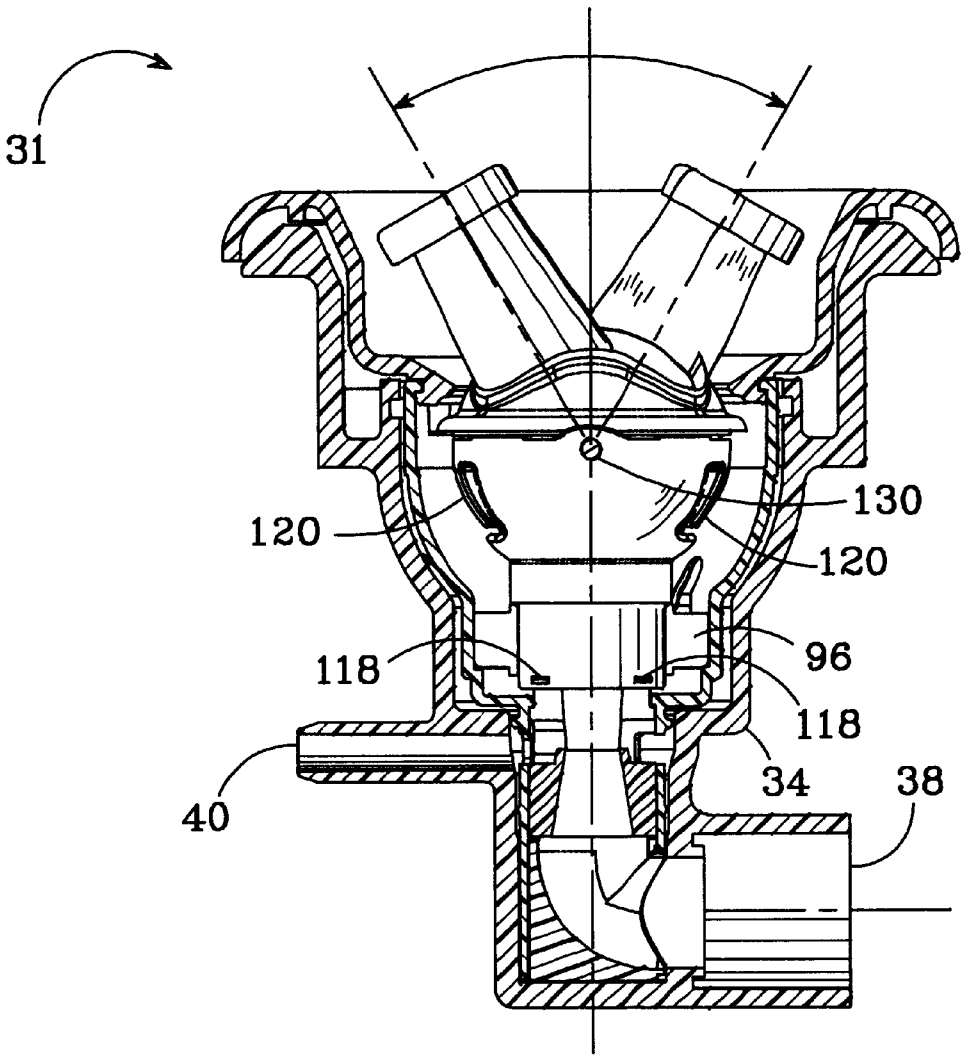
FIG. 4 is a partially sectioned view of the jet shown in FIG. 1 depicting the outlet nozzles' range of adjustment.
Figure 5:
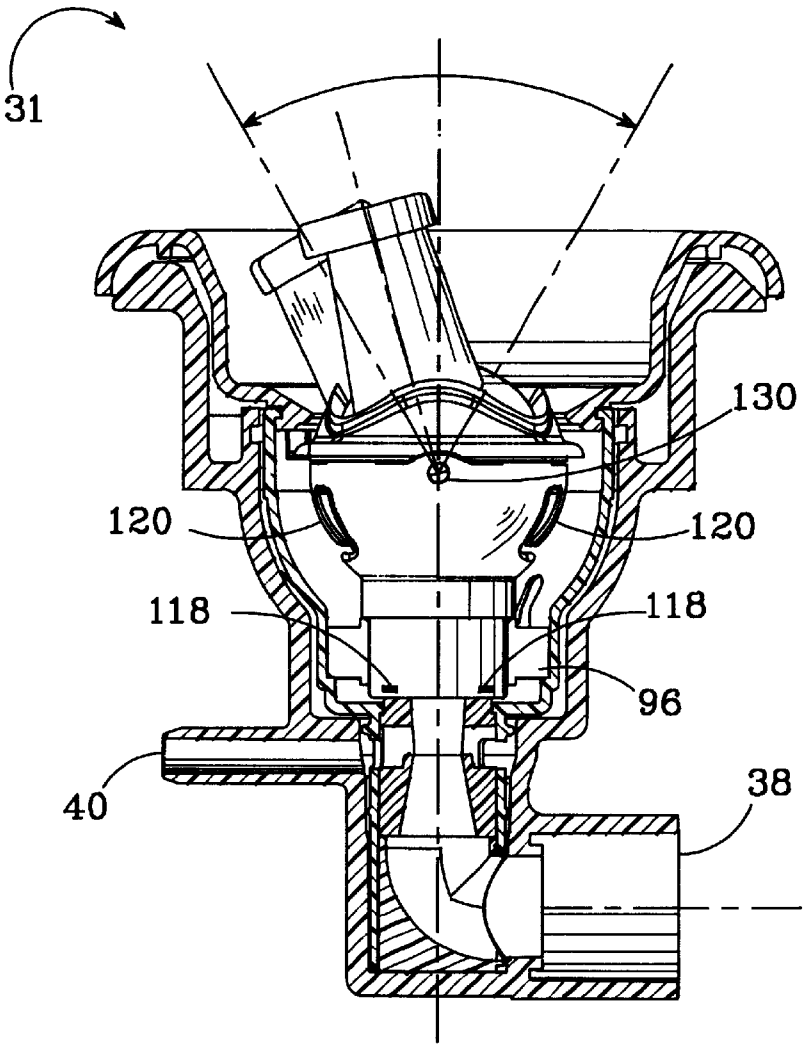
FIG. 5 is a partially sectioned view of the jet shown in FIG. 1 depicting both discharge nozzles displaced in a common direction from center.

Eyeball halves 114 generally consist of a male and female half that are symmetric in design with the exception of the male half having a locking ridge 132 that mates with a corresponding lock slot 134 located on the female half. Each eyeball half has one or more discharge nozzles 24 from which water is exhausted into a spa or tub. The mated eyeball halves 114 form an intersecting ridge 136 that diverts the water flowing through jet 31 into one of the discharge nozzles 24. The eyeball halves 114 are positionable in a scissor like fashion as further shown in FIGS. 4 and 5, to adjust the direction of flow 28 and to vary the direction and speed of rotation of eyeball 22. If the discharge axes 26 of nozzles 24 are aligned such that the axes are parallel with axis 41, forming a common plane, eyeball 22 will not rotate.

The eyeballs halves are capable of being displaced from this common plane approximately 300 or more in both directions. The greater the degree of displacement from the common plane the greater the rotation speed that is achievable by eyeball 22. Depending upon displacement, eyeball 22 will rotate in clockwise direction, if displaced in the opposite direction, eyeball 22 will rotate counterclockwise. With this design, it is also possible to have nozzles 24 both displaced in the same direction from the common plane. Nozzles 24 at their aft end are elliptical in shape and tapers to a cylindrical exit. The taper not only provides for a smooth transition which minimizes pressure losses, but also boosts the pressure of the exit flow 28. However, the nozzles can be of a constant shape, such as elliptical or cylindrical, and also a constant diameter. Located at the forward end of the nozzles are a set of finger tabs 138 which can be grasped by the user to adjust the displacement of the nozzles from the common plane.

Top cage 112 has a series of contoured passageways 140 that act as a guide along which nozzles 24 are adjusted. At the ends of each passageway is a scalloped section that provide a maximum displacement stop. Parallel to the direction of scissoring is a ridge or support 142 that extends from the face of the top cage to support the eyeball halves from separating due to water pressure.

Forward of eyeball 22 is located escutcheon 60 which has at its aft end a series of locking slots 106 into which diverter body 84 is attached. Adjacent to slots 106 is a release tab 144 that rides within a slot 146 located in the forward end of jet body 36. Slot 146 contains a series of release ridges with the first two on each end being lower in height to create a stair-step effect. As escutcheon 60 is rotated release tab 144 rides over the ridges resulting in jet internals 32 being pulled from jet body 36, releasing external tabs 104 from internal slot 108.

In assembly, eyeball halves 114 are first assembled by mating ridge 132 with slot 134 and seating the assembled eyeball into bottom cage 110, inserting mounting pins 130 into mounting holes 128. Top cage 112 is then fastened to bottom cage 110 by locking slot 124 and tab 126 into corresponding tabs and slots located on the top cage 112. Bearing 96 is then inserted onto bottom cage 110 mating sleeve 116 with the inner race of bearing 96. Bearing 96 is further held in place by locking tabs 118, completing the assembly of eyeball 22. Eyeball 22 is then inserted into diverter 62 held in place by bearing clips 100. Venturi 66 is then inserted into the forward end of diverter 62 mating flange 80 with collar 82. Water ramp 64 is then inserted into the forward end of diverter 62, mating with venturi 66. Escutcheon 60 is then mated with diverter 62 completing the assembly of jet internals 31. The jet internals are then inserted into jet body 36 mating tabs 104 with slots 108 completing the assembly of jet 32. It should be noted that the entire assembly process is achieved without the need of any adhesives, lubricants or O-rings.

When assembled, the jet internals 32 can be rotated through an arc of about 90° to adjust the volume of water discharged from the jet. When they are positioned at one end of their rotational limit, water flowing through conduit 38 flows directly into ramp 64 and through jet internals 32. When positioned at the other rotational limit, water conduit 38 and water ramp 64 are not in alignment and water does not flow through jet internals 32. Intermediate levels water flow can be achieved by positioning the jet internals 32 between the limits of rotation.

Figure 6A:
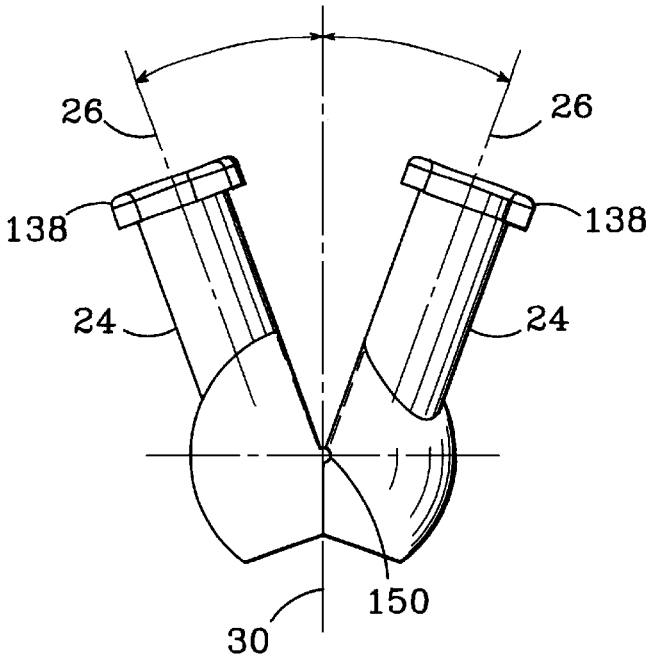
FIGS. 6*a* and 6*b* are respectively elevation and plan views of an alternate split eyeball design.
Figure 6B:
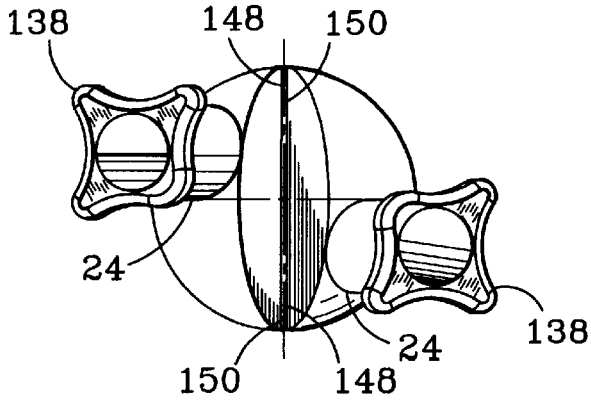
Figure 6C:
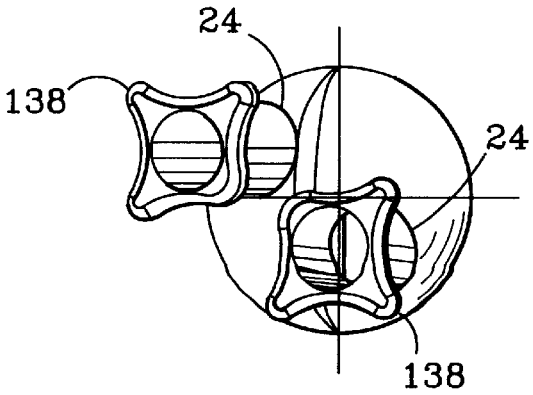
FIG. 6*c* is a plan view of the split eyeball design of FIGS. 6*a* and 6*b* depicting the eyeball displaced from center resulting in both adjustable outlet nozzles being displaced in a common direction from center.

In an alternate configuration of the adjustable multi-nozzle rotary hydrotherapy jet, as shown in FIGS. 6*a*, 6*b*, and 6*c*, eyeball halves 114 are of a "split" design rather than a scissor type. In the split design both halves can be truly symmetric having a discharge nozzle 24 and a mating ridge that at its aft end has a slot and pin combination, 148 and 150 respectively, that mate with their counterpart on the other eyeball half. When the eyeball halves are mated they create a ridge that diverts the water flowing into the eyeball into the discharge nozzles 24. The nozzles are preferably cylindrical but can be elliptical or vary in shape along their length. Located at the forward end of the nozzles are finger tabs 138 used to position the individual nozzles by the jet user.

Like the scissor type configuration, the split design has an orientation in which the discharge axes 26 form a common plane with rotation axis 30. In this orientation eyeball 22 does not rotate. In relation to the common plane, nozzles 24 are adjustable with their axes 26 moving along a series of parallel planes. The greater the displacement the greater the speed of rotation eyeball 22 experiences. As shown in FIG. 6*c*, the design not only makes it possible to have discharge nozzles 24 both displaced in the same direction from the common plane but also permits the entire eyeball to be rotated into a variety of positions to further adjust the individual nozzles.

In assembly, eyeball halves 114 are first connected together mating slot 148 and pin 150 with their appropriate counterpart on the other eyeball half. The assembled eyeball is placed within the bottom cage 110 with top cage 112 clipped in place completing the assembly. Unlike the scissor design, top cage 112 does not require a contoured passageway 140, rather the opening in the top cage is circular in fashion permitting the nozzles 24 to be moved. Furthermore, the eyeball halves 114 do not require ridges 122 to prevent movement but rely upon the pressure of tabs 120 against their outer surface.

Figure 7A:
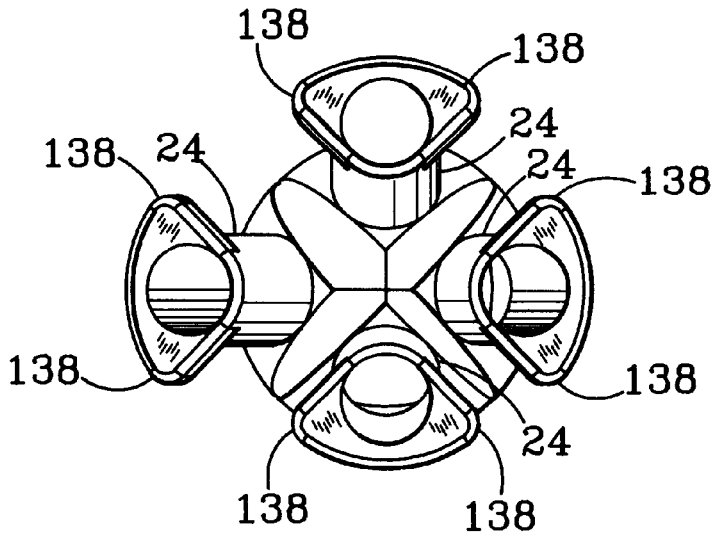
FIGS. 7*a* and 7*b* are respectively plan and elevation views of a second alternate eyeball design having a series of four variable position discharge nozzles.
Figure 7B:
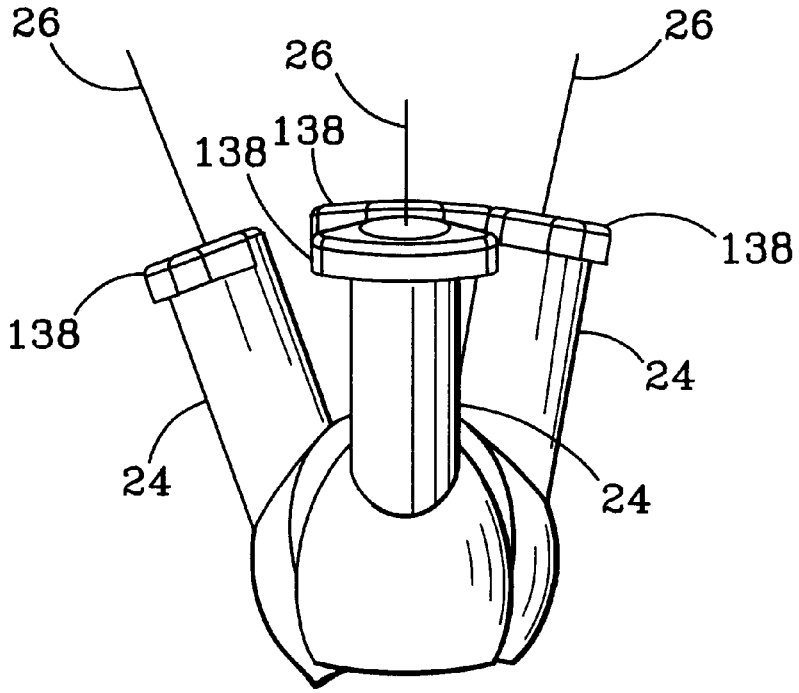

In a second alternate configuration, as shown in FIG. 7*a* and FIG. 7*b* eyeball 22 consists of four or more discharge nozzles 24, each individually adjustable to provide a desired flow effect. In this embodiment, the rotary jet is split into eyeball quarters, with each quarter having one of the four discharge nozzles. Similar to the split design, each quarter is mated with its adjacent quarters by a slot and pin combination. The pins do not continue across the hydrotherapy jet but only run the length of the transition between adjacent quarters. Like the split design, a four nozzle system can be moved as a unit to further modify the direction of discharge axis 26.

Figure 8:
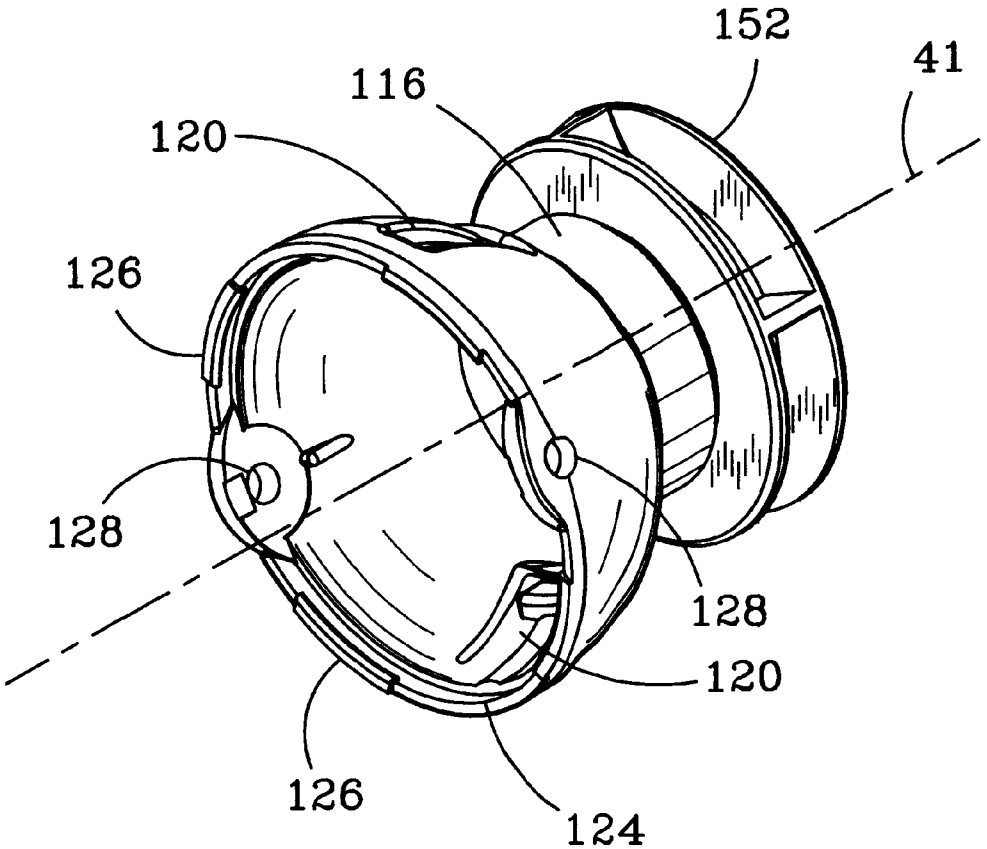
FIG. 8 is a perspective view of an alternative eyeball bottom cage design for a stationary multi-nozzle hydrotherapy jet.

In a third alternate design, as shown in FIG. 8, bottom cage 110 can be of a non-rotary style, replacing bearing 96 with a stationary ring 152. Ring 152 is seated in bearing mount 94, held in place by bearing clips 100. In this configuration, any of the above eyeball designs can be used offering the same degree of adjustability yet lacking rotation.

Figure 9:
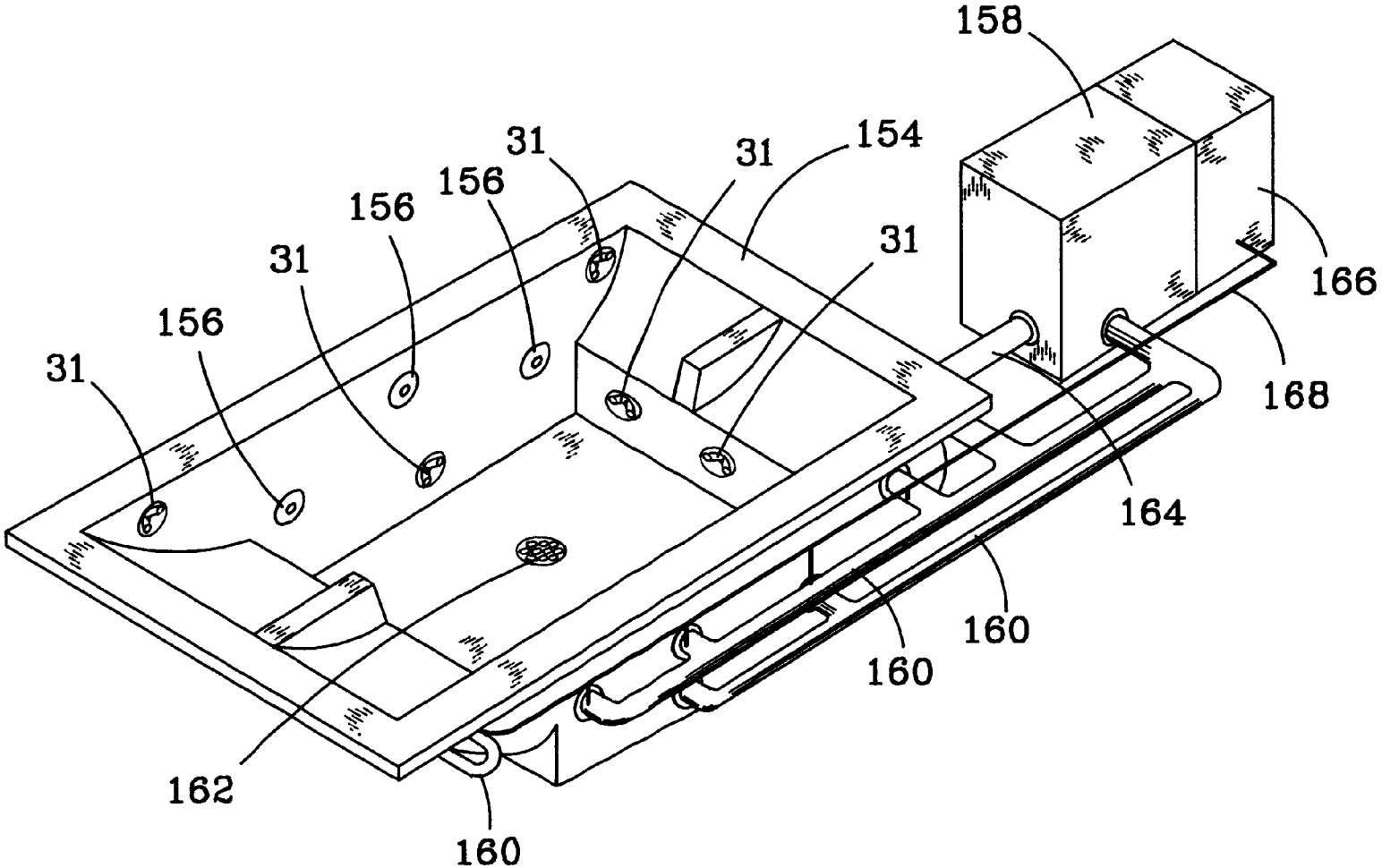
FIG. 9 is a perspective view of a spa system with a series of adjustable multi-nozzle hydrotherapy jets.

As shown in FIG. 9, a series of adjustable multi-nozzle rotary hydrotherapy jet 31 can be installed in a spa or tub shell 154 with the remaining jets 156 being a known type. The jets are connected to a water pump system 158, used to circulate the water throughout by a series of water conduit 160. Water from shell 154 is provided to pump 158 through drain 162 and return water conduit 164. Water from pump 158 is provided back to shell 154 by conduits 160, where it flows into jets 31 and 156, completing the loop. Additionally, an air system 166 can be included to provides air to individual jets 31 and 156 to aerate the water flowing through the jet. The air is provided to the jets by an air conduit 168. System 166 can be pump driven to increase the pressure of the air that enters the jets, or can be vacuum based in which the venturi located within the jets draw air into the water flow stream.

Although the present invention has been described in considerable detail with references to certain preferred configurations thereof, other versions are possible. Therefore, the spirit and scope of the appended claims should not be limited to their preferred version contained herein.

What is claimed is:

1. A hydrotherapy jet, comprising:

a jet body;

a water inlet in said body;

a water passageway within said body for forming water flowing through said inlet into a jet of water;

a multi-nozzle carrier attached to said body such that said carrier is clockwise and counter-clockwise rotatable; and a plurality of discharge nozzles that are carried by said carrier and are independently adjustable relative to said carrier, said nozzles positioned to receive and discharge said jet of water along a discharge axis, said nozzles being adjustable to vary said carrier's direction of rotation.

2. The hydrotherapy jet of claim 1, wherein said multi-nozzle carrier is rotatably attached to said body to permit it to rotate.

3. A hydrotherapy jet, comprising:

a jet body;

a water inlet in said body;

a water passageway within said body for forming water flowing through said inlet into a jet of water;

a multi-nozzle carrier attached to said body; and a plurality of discharge nozzles that are carried by said carrier and are adjustable relative to said carrier, said nozzles positioned to receive and discharge said jet of water along a discharge axis, wherein said carrier is rotatably attached to said body to permit it to rotate clockwise or counter-clockwise about a rotation axis, and said nozzles are adjustable to vary the direction of rotation of said carrier about said axis.

4. The hydrotherapy jet of claim 3, wherein said nozzles are adjustable to vary the speed of rotation of said carrier about said axis.

5. The hydrotherapy jet of claim 3, wherein said jet body is rotatable through an arc to adjust the volume of water flowing through said hydrotherapy jet.

6. The hydrotherapy jet of claim 3, wherein said nozzles are adjustable to include an orientation in which said discharge axes are parallel and at which said carrier does not rotate.

7. The hydrotherapy jet of claim 6, wherein said discharge axes at said parallel orientation adjustment are in a substantially common plane with a rotation axis of said carrier, said nozzles being adjustable along a plane that is substantially perpendicular to said common plane.

8. The hydrotherapy jet of claim 7, wherein said nozzles are adjustable in a common direction from said parallel orientation.

9. The hydrotherapy jet of claim 7, wherein at least one of said nozzles is adjustable in opposite directions from said parallel orientation to rotate said carrier in opposite directions.

10. The hydrotherapy jet of claim 7, wherein a plurality of said nozzles are adjustable in opposite directions and from each other.

11. A hydrotherapy jet, comprising:

a jet body;

a water inlet in said body;

a water passageway within said body for forming water flowing through said inlet into a jet of water;

a multi-nozzle carrier attached to said body; and a plurality of discharge nozzles that are carried by said carrier and are adjustable relative to said carrier, said nozzles positioned to receive and discharge said jet of water along a discharge axis, wherein said carrier is rotatably attached to said body to permit it to rotate clockwise or counterclockwise and the adjustment of said nozzles varies said carrier's direction of rotation, said carrier further comprises a top cage having a series of contoured passageways along which said nozzles are adjustable.

12. The hydrotherapy jet of claim 11, wherein said pathways have respective edge structures to support the respective nozzles.

13. A hydrotherapy jet, comprising:

a jet body;

a water inlet in said body;

a water passageway within said body for forming water flowing through said inlet into jet of water;

a multi-nozzle carrier attached to said body; and a plurality of discharge nozzles that are carried by said carrier and are adjustable relative to said carrier, said nozzles positioned to receive and discharge said jet of water along a discharge axis, wherein said carrier is rotatably attached to said body to permit it to rotate and said carrier comprises a ball portion of an eyeball-type outlet and a rotatable cage capturing said ball portion, with said nozzles carried by said ball portion and adjustable to a parallel orientation.

14. The hydrotherapy jet of claim 13, wherein said nozzles are adjustable to vary the speed of rotation of said carrier about said axis.

15. The hydrotherapy jet of claim 13, wherein said jet body is rotatable through an arc to adjust the volume of water flowing through said water passageway.

16. The hydrotherapy jet of claim 13, wherein each of said nozzles carried by said ball portion are independently adjustable over a range of angles relative to the other said nozzles.

17. The hydrotherapy jet of claim 16, wherein said nozzles have discharge axes at said parallel orientation adjustment that are in a substantially common plane with an axis of said ball portion, said nozzles being adjustable along a plane that is substantially perpendicular to said common plane.

18. The hydrotherapy jet of claim 16, wherein said nozzles at said parallel orientation are in a substantially common plane with the axis of said ball portion and are adjustable along planes parallel to one another.

19. The hydrotherapy jet of claim 16, wherein each of said nozzles at said parallel orientation forms a plane with the axis of said ball portion and wherein at least one of said nozzles is adjustable along said plane.

20. The hydrotherapy jet of claim 13, wherein said nozzles have respective surfaces that manually engage said cage to restrict adjustment.

21. The hydrotherapy jet of claim 2, wherein said nozzles have elliptical upstream ends that receive said water jet and taper to circular downstream ends from which said water is discharged.

22. A hydrotherapy jet, comprising:

a jet body;

a water inlet in said body;

a water passageway within said body for forming water flowing through said inlet into a jet of water;

a multi-nozzle carrier attached to said body; and a plurality of discharge nozzles that are carried by said carrier and are adjustable relative to said carrier, said nozzles positioned to receive and discharge said jet of water along a discharge axis, wherein said carrier is rotatably attached to said body to permit it to rotate clockwise or counter-clockwise and the adjustment of said nozzles varies said carrier's direction of rotation, said nozzles have elliptic upstream ends that receive said water jet and taper to circulate downstream ends from which said water is discharged, and said nozzles are mated together and are captured by said carrier.

23. The hydrotherapy jet of claim 22, wherein said nozzles are mated by engaging a ridge on one nozzle with a grove on a second nozzle.

24. A hydrotherapy jet, comprising:

a jet body;

a water inlet in said body;

a water passageway within said body for forming water flowing through said inlet into jet of water;

a multi-nozzle carrier attached to said body; and a plurality of discharge nozzles that are carried by said carrier and are adjustable relative to said carrier, said nozzles positioned to receive and discharge said jet of water along a discharge axis, wherein said carrier is rotatably attached to said body to permit it to rotate clockwise or counter-clockwise, the adjustment of said nozzles varying said carrier's direction of rotation, and said nozzles have a tubular forward end having flanges with straight sections that abut each other when the nozzles are parallel.

25. A spa system, comprising:

a spa shell that is capable of holding water;

a plurality of multi-nozzle hydrotherapy jets mounted around said spa shell wherein, said nozzles on each said hydrotherapy jet rotate clockwise or counter-clockwise about a rotation axis and the angles of said nozzles are independently adjustable to vary their direction of rotation; and a water pump system that circulates water throughout said spa by providing water to said jets and receiving water from said spa.

26. The system of claim 25, wherein each of said adjustable multi-nozzle hydrotherapy jets comprises:

a jet body;

a water inlet in said body;

a water passageway within said body for forming water flowing through said inlet into a jet of water;

a multi-nozzle carrier attached to said body, for carrying said nozzles; and said nozzles independently adjustable relative to said carrier, said nozzles positioned to receive and discharge said jet of water along a discharge axis.

27. The hydrotherapy jet of claim 26, wherein said nozzles are adjustable to vary the speed of rotation of said carrier about said axis.

28. The hydrotherapy jet of claim 26, wherein said jet body is rotatable through an arc to adjust the volume of water flowing through said hydrotherapy jet.

29. The hydrotherapy jet of claim 26, wherein said multi-nozzle carrier is rotatably attached to said body to permit it to rotate.

30. A spa system, comprising:

a spa shell that is capable of holding water;

a plurality of multi-nozzle hydrotherapy jets mounted around said spa shell wherein, for each jet, the angles of said nozzles are adjustable, each said adjustable multi-nozzle hydrotherapy jet, comprises:

a jet body;

a water inlet in said body;

a water passageway within said body for forming water flowing through said inlet into a jet of water;

a multi-nozzle carrier attached to said body, said carrier able to rotate clockwise or counterclockwise about a rotational axis; and a plurality of discharge nozzles that are carried by said carrier and are adjustable relative to said carrier, said nozzles positioned to receive and discharge said jet of water along a discharge axis, wherein said nozzles are adjustable to vary the direction of rotation of said carrier about said axis; and a water pump system that circulates water throughout said spa by providing water to said jets and receiving water from said spa.

31. The hydrotherapy jet of claim 29, wherein said nozzles are adjustable to include an orientation in which said discharge axes are parallel and at which said carrier does not rotate.

32. The hydrotherapy jet of claim 31, wherein said discharge axes at said parallel orientation adjustment are in a substantially common plane with a rotation axis of said carrier, said nozzles being adjustable along a plane that is substantially perpendicular to said common plane.

33. The hydrotherapy jet of claim 32, wherein said nozzles are adjustable in a common direction from said parallel orientation.

34. The hydrotherapy jet of claim 32, wherein at least one of said nozzles is adjustable in opposite directions from said parallel orientation to rotate said carrier in opposite directions.

35. The hydrotherapy jet of claim 32, wherein a plurality of said nozzles are adjustable in opposite directions and from each other.

36. A spa system, comprising:

a spa shell that is capable of holding water;

a plurality of multi-nozzle hydrotherapy jets mounted around said spa shell wherein, for each jet, the angle of said nozzles are adjustable, each said adjustable multi-nozzle hydrotherapy jet, comprises:

a jet body;

a water inlet in said body;

a water passageway within said body for forming water flowing through said inlet into a jet of water;

a multi-nozzle carrier attached to said body, said carrier able to rotate clockwise or counter-clockwise about a rotation axis; and a plurality of discharge nozzles that are carried by said carrier and are adjustable relative to said carrier to vary the direction of rotation of said carrier about said axis, said nozzles positioned to receive and discharge said jet of water along a discharge axis, wherein said nozzle carrier further comprises a top cage having a series of contoured passageways along which said nozzles are adjustable; and a water pump system that circulates water throughout said spa by providing water to said jets and receiving water from said spa.

37. The hydrotherapy jet of claim 36, wherein said nozzles are adjustable to vary the speed of rotation of said carrier about said axis.

38. The hydrotherapy jet of claim 36, wherein said jet body is rotatable through an arc to adjust the volume of water flowing through said water passageway.

39. The hydrotherapy jet of claim 36, wherein said pathways have respective edge structures to support the respective nozzles.

40. A spa system, comprising:

a spa shell that is capable of holding water;

a plurality of multi-nozzle hydrotherapy jets mounted around said spa shell wherein, for each jet, the angle of said nozzles are adjustable, each said adjustable multi-nozzle hydrotherapy jet, comprises:

a jet body;

a water inlet in said body;

a water passageway within said body for forming water flowing through said inlet into a jet of water;

a multi-nozzle carrier attached to said body; and a plurality of discharge nozzles that are carried by said carrier and are adjustable relative to said carrier, said nozzles positioned to receive and discharge said jet of water along a discharge axis, wherein said nozzle carrier comprises a ball portion of an eyeball-type outlet and a rotatable socket capturing said ball portion, with said nozzles carried by said ball portion and adjustable to a parallel orientation; and a water pump system that circulates water throughout said spa by providing water to said jets and receiving water from said spa.

41. The hydrotherapy jet of claim 40, wherein each of said nozzles carried by said ball portion are independently adjustable over a range of angles relative to the other said nozzles.

42. The hydrotherapy jet of claim 41, wherein said nozzles have discharge axes at said parallel orientation adjustment that are in a substantially common plane with an axis of said ball portion, said nozzles being adjustable along a plane that is substantially perpendicular to said common plane.

43. The hydrotherapy jet of claim 41, wherein said nozzles at said parallel orientation are in a substantially common plane with the axis of said ball portion and are adjustable along planes parallel to one another.

44. The hydrotherapy jet of claim 41, wherein each of said nozzles at said parallel orientation forms a plane with the axis of said ball portion and wherein at least one of said nozzles is adjustable along said plane.

45. The hydrotherapy jet of claim 40, wherein said nozzles have respective surfaces that manually engage said socket portion to restrict adjustment.

46. The hydrotherapy jet of claim 40, wherein said nozzles have elliptical upstream ends that receive said water jet and taper to circular downstream ends from which said water is discharged.

47. The hydrotherapy jet of claim 46, wherein said nozzles are mated together and are captured by said carrier.

48. The hydrotherapy jet of claim 47, wherein said nozzles are mated by engaging a ridge on one nozzle with a grove on a second nozzle.

49. A spa system, comprising:

a spa shell that is capable of holding water;

a plurality of multi-nozzle hydrotherapy jets mounted around said spa shell wherein, for each jet, the angle of said nozzles are adjustable, each said adjustable multi-nozzle hydrotherapy jet, comprises:

a jet body;

a water inlet in said body;

a water passageway within said body for forming water flowing through said inlet into a jet of water;

a multi-nozzle carrier attached to said body, said carrier able to rotate clockwise and counter-clockwise about a rotation axis; and a plurality of discharge nozzles that are carried by said carrier and are adjustable relative to said carrier to vary the direction of rotation of said carrier about said axis, said nozzles positioned to receive and discharge said jet of water along a discharge axis, and wherein said nozzles have a tubular forward end having flanges with straight sections that abut each other when the nozzles are parallel; and a water pump system that circulates water throughout said spa by providing water to said jets and receiving water from said spa.

* * * * *